US009097136B2

(12) United States Patent
Chouhan et al.

(10) Patent No.: US 9,097,136 B2
(45) Date of Patent: Aug. 4, 2015

(54) CONTOURED HONEYCOMB SEAL FOR TURBINE SHROUD

(75) Inventors: Rohit Chouhan, Bangalore Karnataka (IN); Georgia L. Fleming, Mauldin, SC (US); Sumeet Soni, Bangalore Karnataka (IN)

(73) Assignee: General Electric Company, Schenectady, NY (US)

( * ) Notice: Subject to any disclaimer, the term of this patent is extended or adjusted under 35 U.S.C. 154(b) by 735 days.

(21) Appl. No.: 13/342,273

(22) Filed: Jan. 3, 2012

(65) Prior Publication Data

US 2013/0170964 A1 Jul. 4, 2013

(51) Int. Cl.
*F01D 11/12* (2006.01)
*F01D 5/22* (2006.01)

(52) U.S. Cl.
CPC ..... *F01D 11/127* (2013.01); *F01D 5/225* (2013.01)

(58) Field of Classification Search
CPC ..... F01D 11/00; F01D 11/08; F01D 11/12; F01D 11/127
USPC ..... 415/1, 170.1, 173.1, 173.2, 173.4, 415/173.5, 173.6, 174.4, 174.5
See application file for complete search history.

(56) References Cited

U.S. PATENT DOCUMENTS

| | | | | |
|---|---|---|---|---|
| 3,871,174 | A * | 3/1975 | Buisson et al. | 60/762 |
| 3,876,330 | A * | 4/1975 | Pearson et al. | 416/92 |
| 5,201,846 | A * | 4/1993 | Sweeney | 415/173.6 |
| 6,146,089 | A * | 11/2000 | Allen et al. | 415/9 |
| 6,341,938 | B1 * | 1/2002 | Zegarski et al. | 415/173.4 |
| 7,029,232 | B2 * | 4/2006 | Tuffs et al. | 415/173.1 |
| 7,789,619 | B2 * | 9/2010 | Durand et al. | 415/173.1 |
| 2005/0002779 | A1 * | 1/2005 | Tanaka | 415/173.1 |
| 2008/0240915 | A1 * | 10/2008 | Castel et al. | 415/208.2 |
| 2011/0085893 | A1 | 4/2011 | Jain et al. | |

* cited by examiner

*Primary Examiner* — Edward Look
*Assistant Examiner* — Danielle M Christensen
(74) *Attorney, Agent, or Firm* — Sutherland Asbill & Brennan LLP

(57) ABSTRACT

The present application provides a stage of a turbine engine. The stage may include a bucket, a shroud facing the bucket, and a contoured honeycomb seal on the shroud. The contoured honeycomb seal may include a first step with a first shape and a second step with a contoured shape.

16 Claims, 5 Drawing Sheets

CONTOURED HONEYCOMB SEAL FOR TURBINE SHROUD

TECHNICAL FIELD

The present application and the resultant patent relate generally to gas turbine engines and more particularly relate to a contoured honeycomb seal for a shroud of a last stage of a turbine.

BACKGROUND OF THE INVENTION

Generally described, a gas turbine engine includes a combustor to produce a flow of hot combustion gases. The hot combustion gases are directed towards a turbine. The hot combustion gases impart a rotational force on the turbine blades therein so as to create mechanical energy. The turbine blades include end portions that rotate in close proximity to a turbine casing and the like. The closer the tip portions of the turbine blades are to the turbine casing, the lower the energy loss therein. Specifically, when clearances between the tip portions and the turbine casing are relatively high, the high energy combustion gases may escape without producing useful work. Reducing the clearance therein ensures that a larger portion of the thermal energy of the combustion gases is converted to mechanical energy so as to provide increased output and overall efficiency.

There is thus a desire for improved sealing system for use in a gas turbine engine. Preferably, such improved sealing systems may provide increased efficiency in both a turbine and a downstream diffuser while also providing overall increased power output.

SUMMARY OF THE INVENTION

The present application and the resultant patent thus provide a stage of a turbine engine. The stage may include a bucket, a shroud facing the bucket, and a contoured honeycomb seal on the shroud. The contoured honeycomb seal may include a first step with a first shape and a second step with a contoured shape.

The present application and the resultant patent further may provide a turbine for a gas turbine engine. The turbine may include a number of stages, a number of buckets, a shroud surrounding the buckets, a contoured honeycomb seal positioned on the shroud and facing a bucket of a last turbine stage, and a diffuser downstream of the last turbine stage.

The present application and the resultant patent further may provide a stage of a gas turbine engine. The stage may include a bucket, a shroud facing the bucket, a contoured honeycomb seal on the shroud with a first step and a contoured second step, and a contoured shroud aft end downstream of the contoured honeycomb seal.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
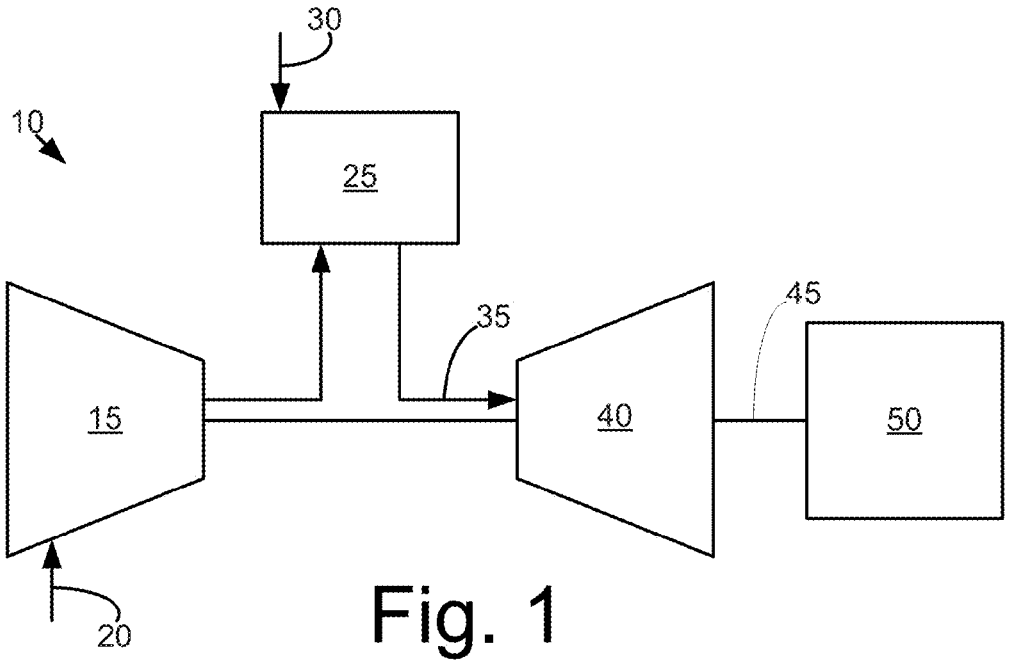
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y., including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
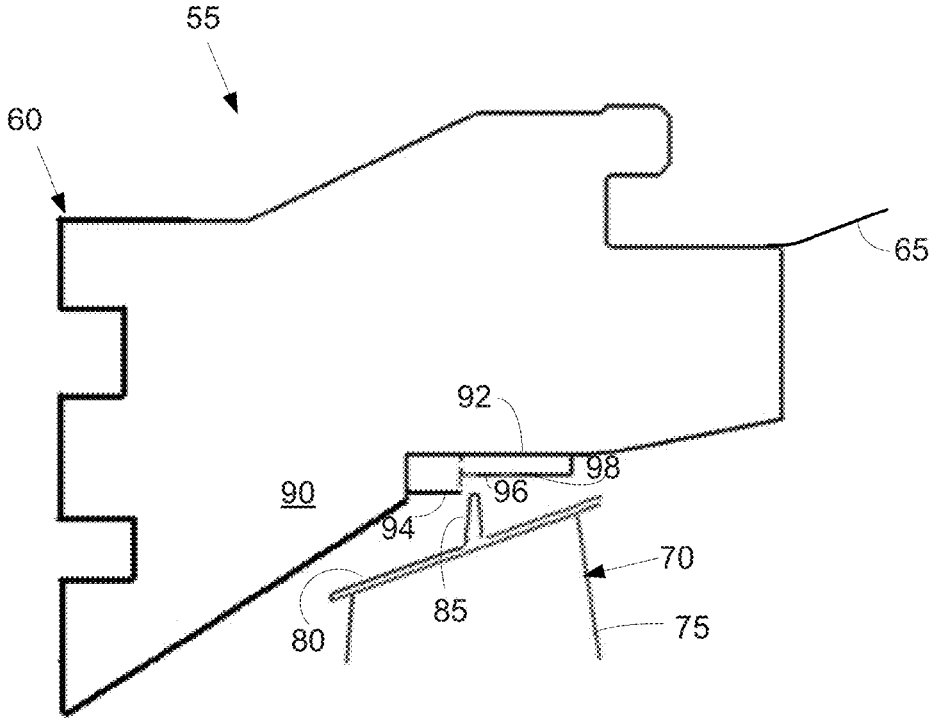
FIG. 2 is a side view of turbine stage with a known honeycomb seal therein.

FIG. 2 shows a portion of a turbine stage 55. The turbine stage 55 may be part of the turbine 40 described above and the like. In this example, the turbine stage 55 may be a fourth stage or a last stage 60 of the turbine 40. As such, the turbine stage 55 may be positioned adjacent to a diffuser 65. The turbine stage 55 may include a bucket 70. The bucket 70 may include an airfoil 75. The airfoil 75 ends at a tip portion 80. A seal rail or a projection 85 may extend from the tip portion 80. Other components and other configurations may be used herein.

The bucket 70 may be enclosed within a shroud 90. A honeycomb seal member 92 may be mounted on the shroud 90 adjacent to the tip portion 80 of the bucket 70. The honeycomb seal 92 may be formed from a deformable material. The honeycomb seal 92 may have a substantial step-like shape with a first step 94 and a second step 96. The seal rail 85 may be positioned anywhere between the two steps 94, 96.

The steps 94, 96 may have a substantially straight or linear shape 98. Other components and other configurations may be used herein.

Figure 3:
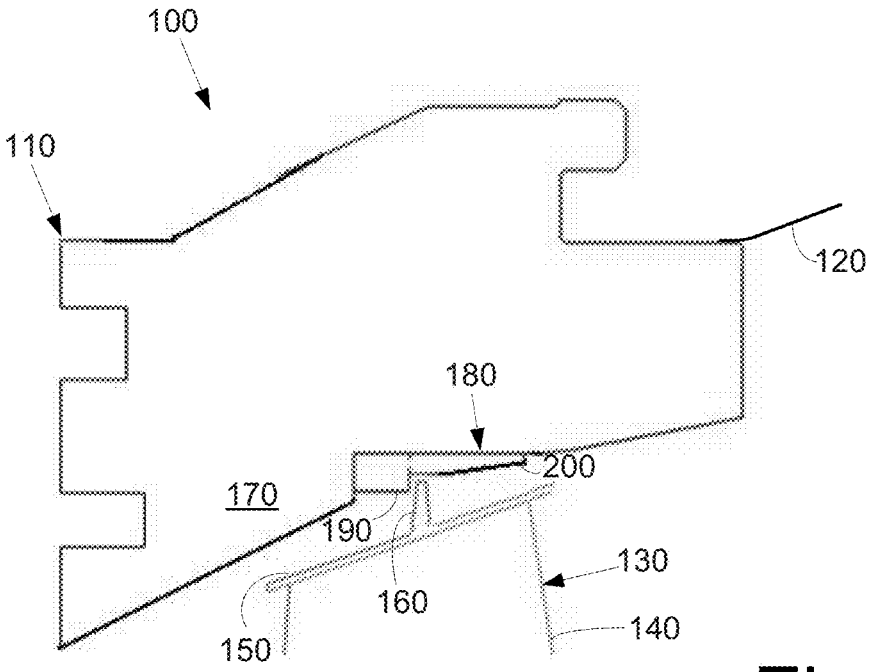
FIG. 3 is a side plan view of a turbine stage with a contoured honeycomb seal as may be described herein.

FIG. 3 shows a portion of a turbine stage 100 as may be described herein. As above, the turbine stage 100 may be used with the turbine 40 of the gas turbine engine 10. The turbine stage 100 may be a fourth stage or a last stage 110. The last stage 110 may be positioned adjacent to a diffuser 120. The turbine stage 100 may include a bucket 130 therein. The bucket 130 may include an airfoil 140. The airfoil 140 may have a tip portion 150 at one end thereof. The tip portion 150 may have a seal rail or a projection 160 extending therefrom. Other components and other configurations may be used herein.

Figure 4:
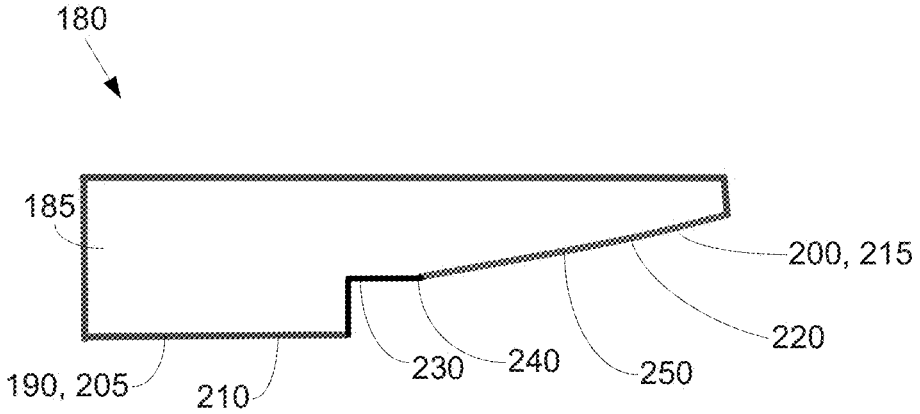
FIG. 4 is a side plan view of the contoured honeycomb seal of FIG. 3.

A static shroud 170 may enclose the bucket 130. As is shown in FIGS. 3 and 4, the contoured honeycomb seal member 180 may be mounted on the shroud 170 about the tip portion 150 of the bucket 130. The contoured honeycomb seal 180 may be formed from a deformable material 185. The contoured honeycomb seal 180 may include a first step 190 and a second step 200. The projection 160 of the tip portion 150 may be positioned anywhere below the first step 190 or the second step 200. The first step 190 may have a first shape 205. In this example, the first shape 205 may be a substantially flat linear shape 210.

The second step 200 of the contoured honeycomb seal 180 may have a second shape 215. In this example, the second shape 215 may be a partially contoured shape 220. The partially contoured shape 220 may decrease in depth downstream about from the intersection 230 towards the diffuser 120 at an end of the contoured honeycomb seal 180. The partially contoured shape 220 may include a second step linear portion 240 about the intersection 230 that leads downstream to a second step contoured portion 250. The angle, depth, and curvature of the partially contoured shape 220 may vary. The second step 200 may be longer or shorter than the first step 190. Other components and other configurations may be used herein.

In use, the flow of combustion gases 35 extends between the tip portion 150 of the bucket 130 and the contoured honeycomb seal 180 of the shroud 170. The elimination of the second step 96 with the linear shape 98 in the contoured honeycomb seal 180 described herein provides an increase in performance in the turbine stage 100. Moreover, additional performance benefits are provided in the diffuser 120. Specifically, the use of the partially contoured shape 220 in the contoured honeycomb seal 180 alone or in combination with the shape of the diffuser 120 improves the flow condition for the diffuser. Improved flow condition for the diffuser 120 means improved radial and swirl flow angles and a total pressure favorable to diffuser performance. A higher inlet pressure (PTA) and radial flow angle (Phi) may reduce flow separation in the diffuser 120 during part load conditions and otherwise.

Although the turbine stage 100 has been described herein in terms of the last stage 110, the contoured honeycomb seal 180 with the partially contoured shape 220 may be applicable to other stages and other locations as well. The use of the partially contoured shape 220 thus improves stage efficiency, diffuser performance, and overall gas turbine performance. The contoured honeycomb seal 180 may be original equipment of part of a repair or a retrofit.

Figure 5:
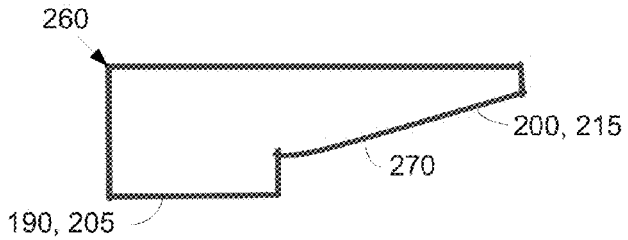
FIG. 5 is a side plan view of an alternative embodiment of a contoured honeycomb seal as may be described herein.
Figure 6:
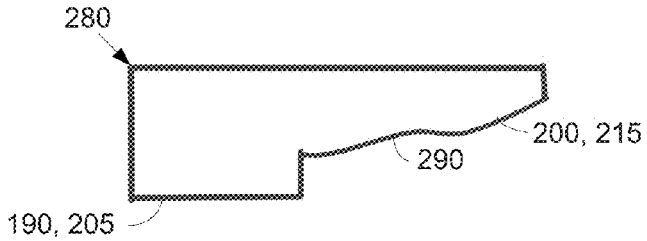
FIG. 6 is a side plan view of an alternative embodiment of a contoured honeycomb seal as may be described herein.
Figure 7:
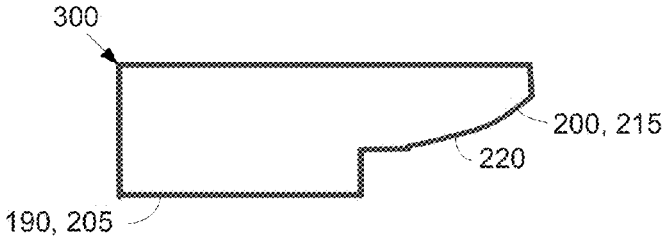
FIG. 7 is a side plan view of an alternative embodiment of a contoured honeycomb seal as may be described herein.
Figure 8:
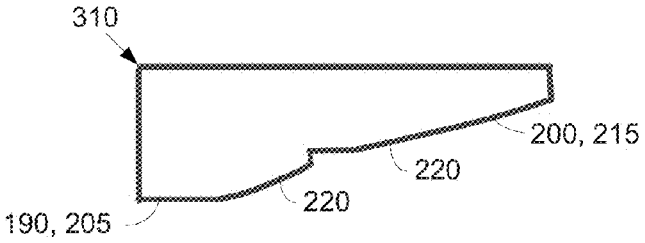
FIG. 8 is a side plan view of an alternative embodiment of a contoured honeycomb seal as may be described herein.
Figure 9:
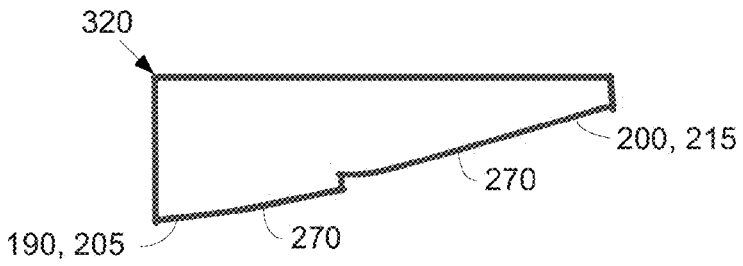
FIG. 9 is a side plan view of an alternative embodiment of a contoured honeycomb seal as may be described herein.
Figure 10:
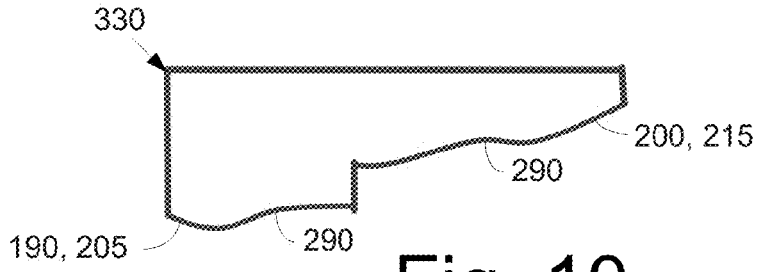
FIG. 10 is a side plan view of an alternative embodiment of a contoured honeycomb seal as may be described herein.
Figure 11:
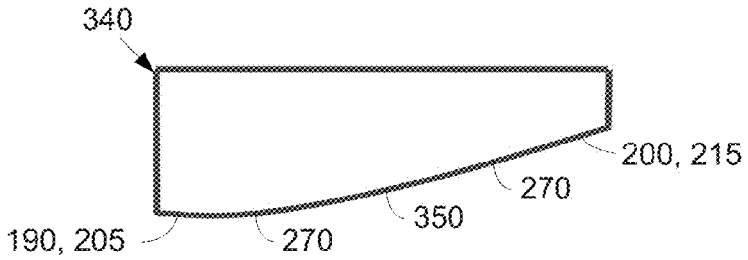
FIG. 11 is a side plan view of an alternative embodiment of a contoured honeycomb seal as may be described herein.

FIGS. 5-11 show various alternative embodiments of the contoured honeycomb seal 180. FIG. 5 shows a contoured honeycombed seal 260 with the first step 190 having the linear shape 210 and the second step 200 having a fully contoured shape 270. FIG. 6 shows a contoured honeycomb seal 280 with the first step 190 having the linear shape 210 and the second step 200 having a variably contoured shape 290. FIG. 7 shows a contoured honeycomb seal 300 with the first step 190 being longer than the second step 200. FIG. 8 shows a contoured honeycomb seal 310 with the first step 190 having the partially contoured shape 220 and the second step 200 also having the partially contoured shape 220. FIG. 9 shows a contoured honeycomb seal 320 with the first step 190 having the fully contoured shape 270 and the second step 200 also having the fully contoured shape 270. FIG. 10 shows a contoured honeycomb seal 330 with the first step 190 having the variable contoured shape 290 and the second step 200 also having the variable contoured shape 290. FIG. 11 shows a contoured honeycomb seal 340 with the first step 190 and second step 200 both having the hilly contoured shape 270 such that a uniformly contoured shape 350 is formed. The contoured honeycomb thus may include a first step with a linear shape and a second step with a contoured shape or vice versa or both steps as contoured shape. Other sizes, shapes, and configurations may be used herein.

Figure 12:
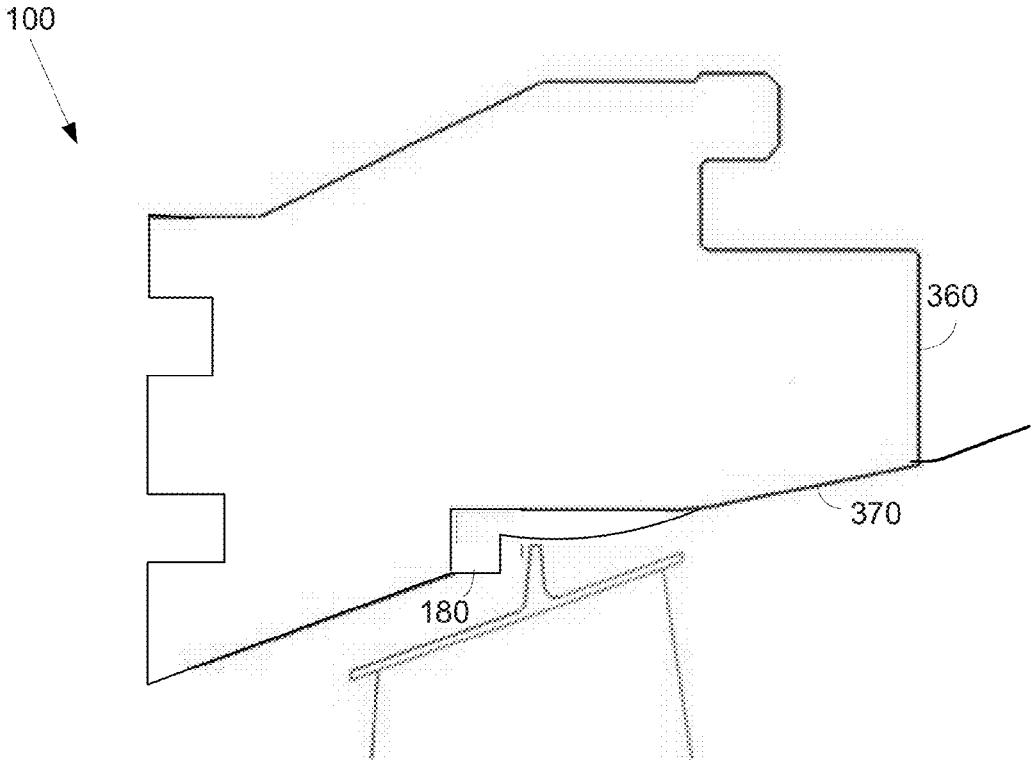
FIG. 12 is a side plan view of an alternative embodiment of a turbine stage with a contoured honeycomb seal as may be described herein

In addition to the contour of the contoured honeycomb seals 180, FIG. 12 shows a shroud aft end 360 adjacent to the last stage 110. In this embodiment, the shroud aft end 360 also includes a shroud contour 370 that cooperates with the contoured honeycomb seal 180. Other configurations and other components also may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A stage of a turbine engine, comprising:

a bucket extending radially about a longitudinal axis of the turbine engine;

a shroud facing the bucket; and a contoured honeycomb seal positioned on the shroud and facing the bucket, the contoured honeycomb seal comprising:

a first step comprising a linear portion extending from an upstream edge of the contoured honeycomb seal, the linear portion of the first step comprising a radially inner surface extending from the upstream edge and substantially parallel to the longitudinal axis of the turbine engine; and a second step comprising: a contoured portion extending to a downstream edge of the contoured honeycomb seal, the contoured portion of the second step comprising a radially inner surface extending to the downstream edge and continuously away from the longitudinal axis of the turbine engine in a downstream direction, the radially inner surface of the contoured portion of the second step exposed along a flow gap between the contoured honeycomb seal and the bucket; and a linear portion positioned upstream of the contoured portion of the second step, the linear portion of the second step comprising a radially inner surface extending substantially parallel to the longitudinal axis of the turbine engine.

2. The stage of claim 1, wherein the first step and the second step meet at an intersection, wherein the linear portion of the first step extends from the upstream edge of the contoured honeycomb seal to the intersection, and wherein the linear portion of the second step extends from the intersection to the contoured portion of the second step.

3. The stage of claim 1, wherein the radially inner surface of the contoured portion of the second step extends away from the longitudinal axis of the turbine engine at a varying rate in the downstream direction.

4. The stage of claim 1, wherein the first step further comprises a contoured portion positioned downstream of the linear portion of the first step, the contoured portion of the first step comprising a radially inner surface extending away from the longitudinal axis of the turbine engine in the downstream direction.

5. The stage of claim 1, wherein the first step has a first axial length, wherein the second step has a second axial length, and wherein the first axial length is less than the second axial length.

6. The stage of claim 1, wherein the stage comprises a last stage of a turbine, and wherein the shroud comprises a contoured shroud aft end positioned downstream of the contoured honeycomb seal, the contoured shroud aft end comprising a radially inner surface extending away from the longitudinal axis of the turbine engine in the downstream direction.

7. The stage of claim 6, wherein the radially inner surface of the contoured portion of the second step is aligned with the radially inner surface of the contoured shroud aft end.

8. The stage of claim 1, wherein the bucket comprises an airfoil, a tip portion, and a seal rail extending towards the contoured honeycomb seal, and wherein the seal rail is positioned downstream of the first step and radially inward of the second step.

9. The stage of claim 1, wherein the contoured honeycomb seal is formed from a deformable material.

10. A turbine of a gas turbine engine, comprising:

a plurality of stages positioned along a longitudinal axis of the turbine, each stage comprising a plurality of buckets extending radially about the longitudinal axis of the turbine;

a shroud surrounding the plurality of buckets;

a contoured honeycomb seal positioned on the shroud and facing a bucket of a last stage of the turbine, the contoured honeycomb seal comprising:

a first step comprising a linear portion extending from an upstream edge of the contoured honeycomb seal, the linear portion of the first step comprising a radially inner surface extending from the upstream edge and substantially parallel to the longitudinal axis of the turbine; and a second step comprising: a contoured portion extending to a downstream edge of the contoured honeycomb seal, the contoured portion of the second step comprising a radially inner surface extending to the downstream edge and continuously away from the longitudinal axis of the turbine in a downstream direction, the radially inner surface of the contoured portion of the second step exposed along a flow gap between the contoured honeycomb seal and the bucket; and a linear portion positioned upstream of the contoured portion of the second step, the linear portion of the second step comprising a radially inner surface extending substantially parallel to the longitudinal axis of the turbine; and a diffuser positioned downstream of the last stage.

11. The turbine of claim 10, wherein the first step and the second step meet at an intersection, wherein the linear portion of the first step extends from the upstream edge of the contoured honeycomb seal to the intersection, and wherein the linear portion of the second step extends from the intersection to the contoured portion of the second step.

12. The turbine of claim 10, wherein the bucket comprises an airfoil, a tip portion, and a seal rail extending towards the contoured honeycomb seal, and wherein the seal rail is positioned downstream of the first step and radially inward of the second step.

13. The turbine of claim 10, wherein the contoured honeycomb seal is formed from a deformable material.

14. The turbine of claim 10, wherein the first step further comprises a contoured portion positioned downstream of the linear portion of the first step, the contoured portion of the first step comprising a radially inner surface extending away from the longitudinal axis of the turbine engine in the downstream direction.

15. The turbine of claim 10, wherein the shroud comprises a contoured shroud aft end positioned downstream of the contoured honeycomb seal, the contoured shroud aft end comprising a radially inner surface extending away from the longitudinal axis of the turbine engine in the downstream direction, and wherein the radially inner surface of the contoured portion of the second step is aligned with the radially inner surface of the contoured shroud aft end.

16. A turbine of a gas turbine engine, comprising:

a bucket extending radially about a longitudinal axis of the turbine;

a shroud facing the bucket; and a contoured honeycomb seal positioned on the shroud and facing the bucket, the contoured honeycomb seal comprising:

a first step comprising a linear portion extending from an upstream edge of the contoured honeycomb seal; the linear portion of the first step comprising a radially inner surface extending from the upstream edge and substantially parallel to the longitudinal axis of the turbine and a second step comprising: a contoured portion extending to a downstream edge of the contoured honeycomb seal, the contoured portion of the second step comprising a radially inner surface extending to the downstream edge and continuously away from the longitudinal axis of the turbine in a downstream direction, the radially inner surface exposed along a flow gap between the contoured honeycomb seal and the bucket; and a linear portion positioned upstream of the contoured portion of the second step, the linear portion of the second step comprising a radially inner surface extending substantially parallel to the longitudinal axis of the turbine;

the shroud comprising a contoured shroud aft end positioned downstream of the contoured honeycomb seal, the contoured shroud aft end comprising a radially inner surface extending away from the longitudinal axis of the turbine in the downstream direction;

wherein the radially inner surface of the contoured portion of the second step is aligned with the radially inner surface of the contoured shroud aft end.

* * * * *